US012480246B2

(12) United States Patent
Roetker et al.

(10) Patent No.: US 12,480,246 B2
(45) Date of Patent: Nov. 25, 2025

(54) DETERGENT DRAWER ASSEMBLY FOR A WASHING MACHINE APPLIANCE

(71) Applicant: Haier US Appliance Solutions, Inc., Wilmington, DE (US)

(72) Inventors: John Joseph Roetker, Louisville, KY (US); Pavan Kumar Madeti, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 36 days.

(21) Appl. No.: 18/584,430

(22) Filed: Feb. 22, 2024

(65) Prior Publication Data

US 2025/0270752 A1 Aug. 28, 2025

(51) Int. Cl.

| | |
|---|---|
| ***D06F 39/02*** | (2006.01) |
| ***D06F 39/08*** | (2006.01) |
| ***D06F 39/10*** | (2006.01) |

(52) U.S. Cl.

CPC ..... *D06F 39/022* (2013.01); *D06F 39/086* (2013.01); *D06F 39/10* (2013.01)

(58) Field of Classification Search

CPC ..... D06F 39/022; D06F 39/086; D06F 39/10
USPC ..... 68/17 R
See application file for complete search history.

(56) References Cited

U.S. PATENT DOCUMENTS

| | | | | |
|---|---|---|---|---|
| 8,505,341 | B2 | 8/2013 | Hendrickson et al. | |
| 9,328,964 | B2 | 5/2016 | Shelnutt et al. | |
| 10,933,790 | B2 | 3/2021 | Keck | |
| 2012/0216836 | A1* | 8/2012 | Hendrickson | D06F 39/022 134/18 |
| 2017/0321369 | A1* | 11/2017 | Del Pos | D06F 39/028 |

FOREIGN PATENT DOCUMENTS

| | | | |
|---|---|---|---|
| KR | 20200117795 | A | 10/2020 |
| WO | WO9859328 | A1 | 12/1998 |
| WO | WO2012051685 | A2 | 4/2012 |

* cited by examiner

*Primary Examiner* — Tinsae B Ayalew
(74) *Attorney, Agent, or Firm* — Dority & Manning, P.A.

(57) ABSTRACT

A washing machine appliance includes a cabinet comprising a front panel defining a chamber opening and a top panel, a wash tub positioned within the cabinet and defining a wash chamber, a wash basket rotatably mounted within the wash tub for receiving a load of clothes, and a detergent drawer assembly slidably mounted within the cabinet for receiving a wash additive and directing the wash additive to the wash chamber during operation of the washing machine appliance. The detergent drawer assembly includes a detergent drawer slidably mounted to the cabinet and defining a cartridge chamber, a hinged plate mounted to the detergent drawer and being rotatable between an open position and a closed position, and a cartridge defining a chamber. The cartridge is slidably mounted to the hinged plate when the hinged plate is in the open position.

20 Claims, 7 Drawing Sheets

DETERGENT DRAWER ASSEMBLY FOR A WASHING MACHINE APPLIANCE

FIELD OF THE INVENTION

The present subject matter relates generally to washing machine appliances, or more specifically, to the detergent drawer assembly of a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Certain conventional washing machine appliances include a detergent drawer assembly for receiving wash additives to be directed to the tub. Notably, detergent drawer assemblies typically include a detergent drawer having chambers within to receive the wash additives and/or water. The chambers occupy accessible space of the detergent drawer, which is the space exposed when the detergent drawer is extended. Notably, there is typically inaccessible space of the detergent drawer, which often corresponds to space covered by the top panel of the washing machine appliance when the detergent drawer is extended. Such inaccessible space, if accessible, could provide additional space within the detergent drawer to be utilized during washing machine appliance operations.

Accordingly, a washing machine appliance having an improved detergent drawer assembly would be desirable. More specifically, a detergent drawer assembly that is capable of providing access to currently inaccessible space within the detergent drawer would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided including a cabinet comprising a front panel defining a chamber opening and a top panel, a wash tub positioned within the cabinet and defining a wash chamber, a wash basket rotatably mounted within the wash tub for receiving a load of clothes, and a detergent drawer assembly slidably mounted within the cabinet for receiving a wash additive and directing the wash additive to the wash chamber during operation of the washing machine appliance. The detergent drawer assembly includes a detergent drawer slidably mounted to the cabinet and defining a cartridge, a hinged plate mounted to the detergent drawer and being rotatable between an open position and a closed position, and a cartridge defining a chamber. The cartridge is slidably mounted to the hinged plate when the hinged plate is in the open position.

In another exemplary embodiment, a detergent drawer assembly for a washing machine appliance is provided. The washing machine appliance includes a cabinet comprising a top panel, a front panel defining a chamber opening, and a wash tub positioned within the cabinet and defining a wash chamber. The detergent drawer assembly is slidably mounted within the cabinet for receiving a wash additive and directing the wash additive to the wash chamber during operation of the washing machine appliance. The detergent drawer assembly includes a detergent drawer slidably mounted to the cabinet and defining a cartridge chamber, a hinged plate mounted to the detergent drawer and being rotatable between an open position and a closed position, and a cartridge defining a chamber. The cartridge is slidably mounted to the hinged plate when the hinged plate is in the open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
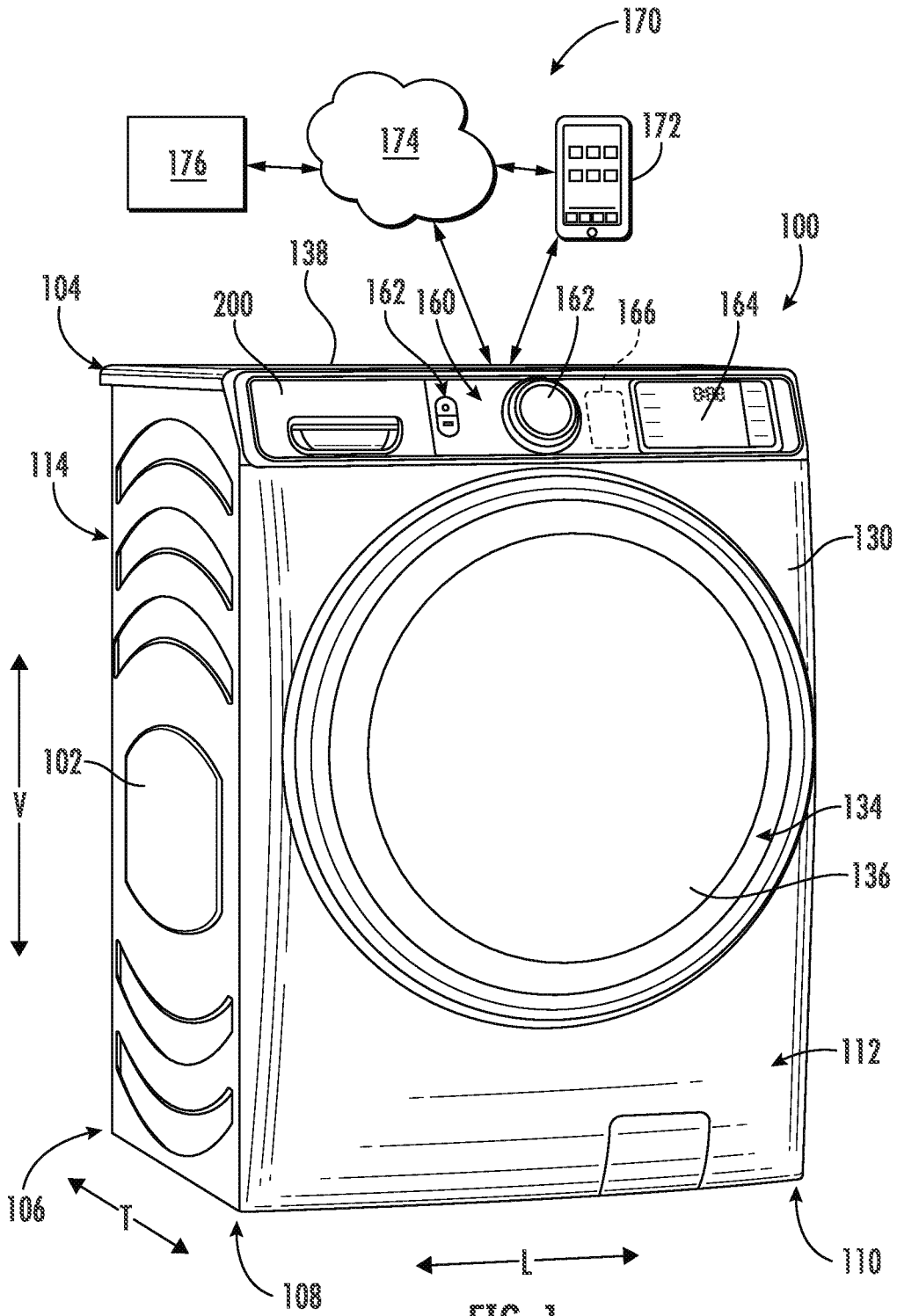
FIG. 1 provides a perspective view of a washing machine appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
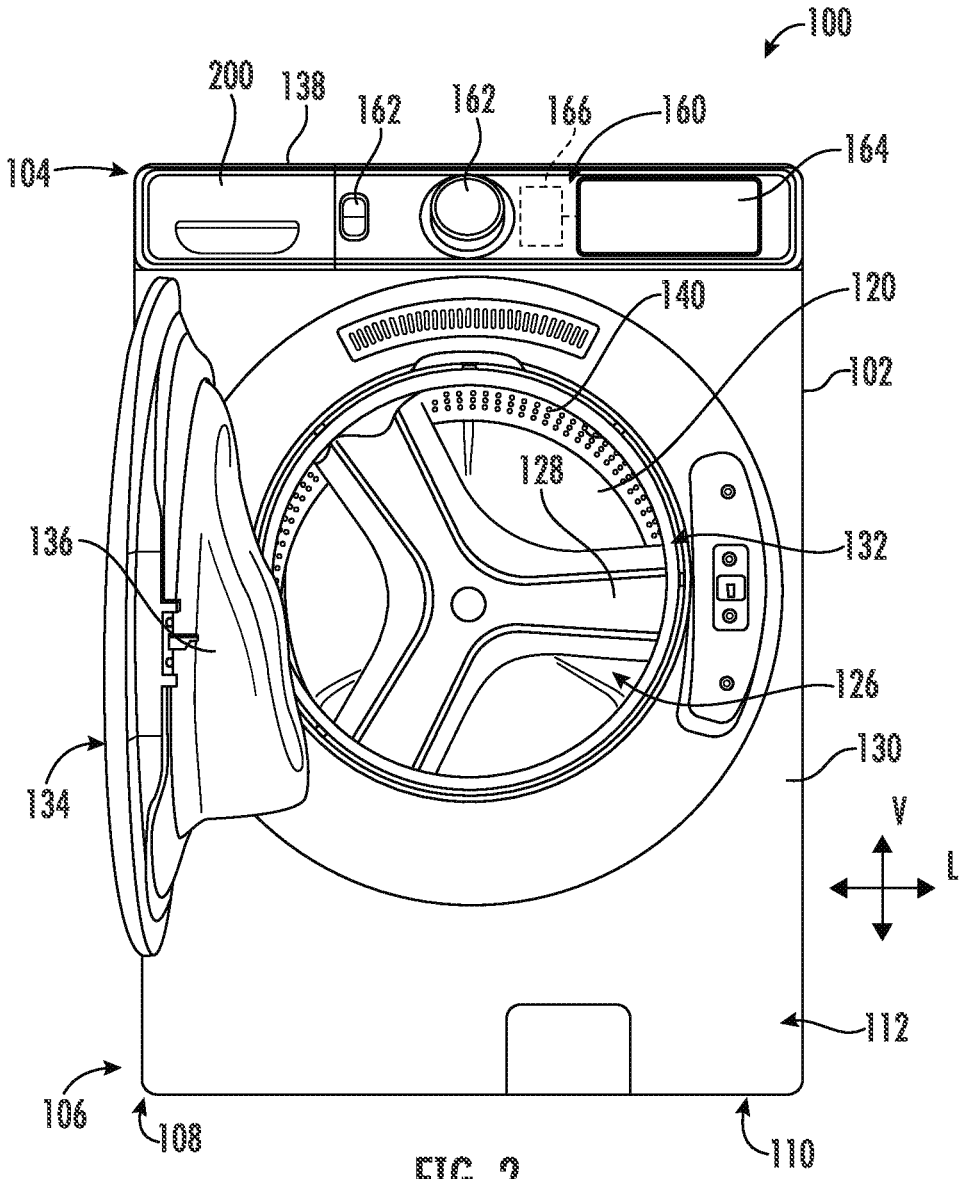
FIG. 2 provides a front view of the example washing machine appliance of FIG. 1 with a door in the open position according to an example embodiment of the present subject matter.
Figure 3:
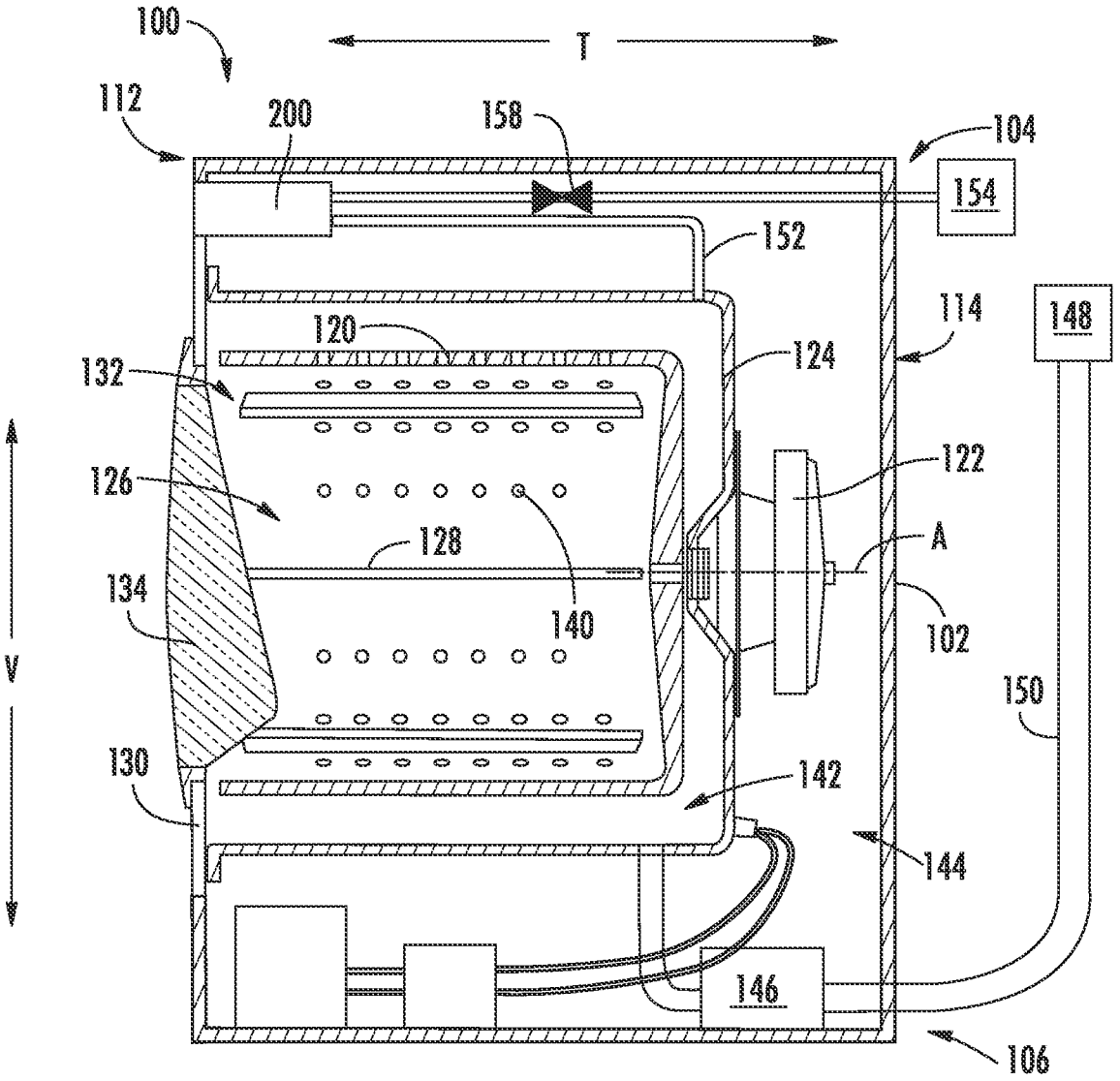
FIG. 3 provides a side cross-sectional view of the example washing machine appliance of FIG. 1 according to an example embodiment of the present subject matter.
Figure 4:
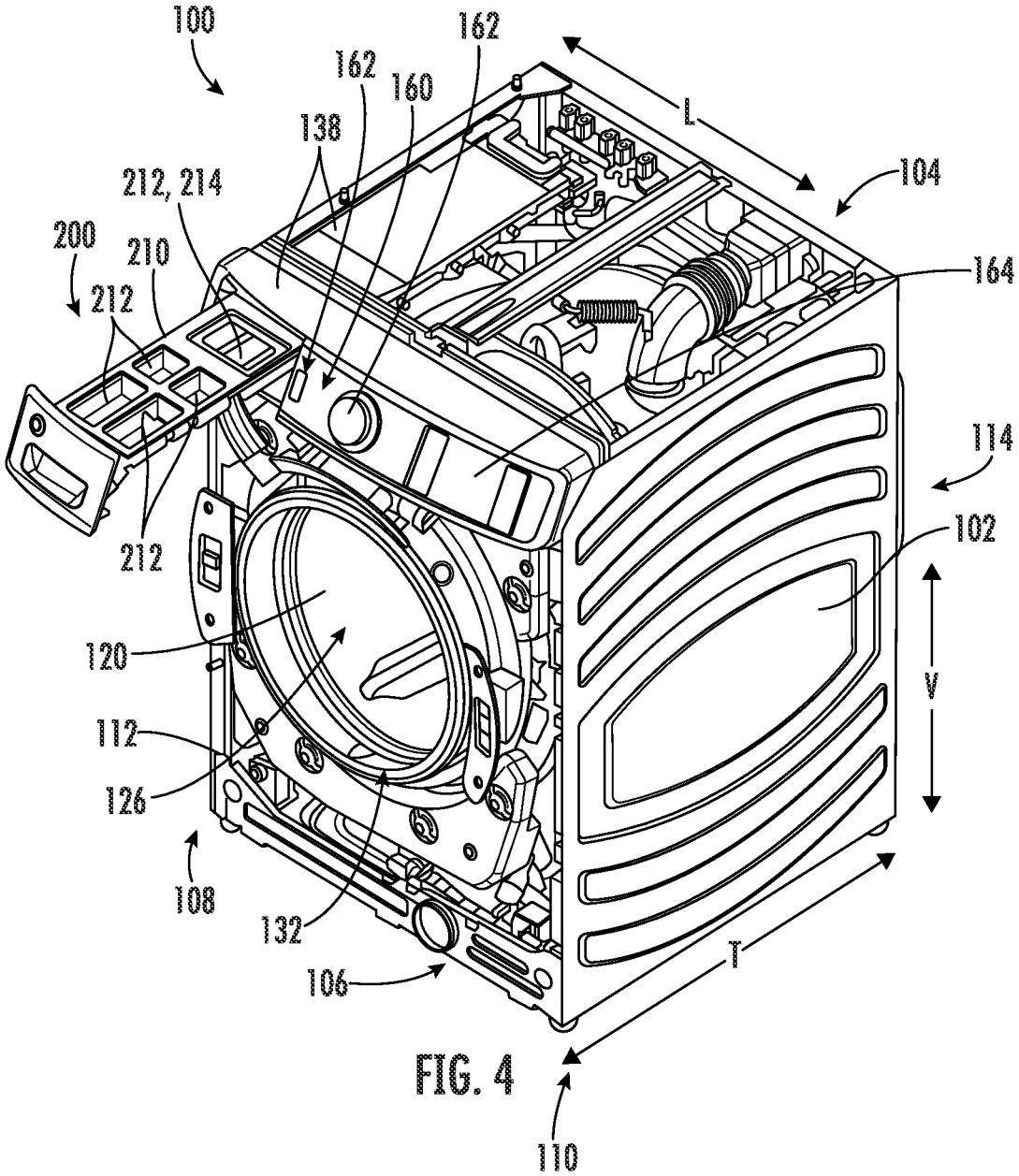
FIG. 4 provides another perspective view of the example washing machine appliance of FIG. 1 with a detergent drawer assembly in an extended position according to an example embodiment of the present subject matter.

Referring now to the figures, FIG. 1 is a perspective view of an exemplary horizontal axis washing machine appliance 100, FIG. 2 is a front view of washing machine appliance 100, FIG. 3 is a side cross-sectional view of washing machine appliance 100, and FIG. 4 is another perspective view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIGS. 2 through 4, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 3, a plurality of ribs 128 extends from basket 120 into wash chamber 126. In this manner, for example, ribs 128 may lift articles disposed in wash basket 120 during rotation of wash basket 120.

Referring generally to FIGS. 1 through 3, cabinet 102 also includes a front panel 130 which defines a chamber opening 132 that permits user access to wash basket 120 of wash tub 124. More specifically, washing machine appliance 100 includes a door 134 that is positioned over chamber opening 132 and is rotatably mounted to front panel 130. In this manner, door 134 permits selective access to chamber opening 132 by being movable between an open position (FIG. 2) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not labeled) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 3, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 3, a detergent drawer assembly 200 is slidably mounted within front panel 130. Detergent drawer assembly 200 receives a wash additive (e.g., detergent, fabric softener, bleach, or any other suitable liquid or powder) and directs the fluid additive to wash tub 124 during operation of washing machine appliance 100. According to the illustrated embodiment, detergent drawer assembly 200 may also be fluidly coupled to spout 152 to facilitate the complete and accurate dispensing of wash additive.

In addition, a water supply valve 156 may provide a flow of water from a water supply source (such as a municipal water supply 154) into detergent drawer assembly 200 and into wash tub 124. In this manner, water supply valve 156 may generally be operable to supply water into detergent drawer assembly 200 to generate a wash fluid, e.g., for use in a wash cycle, or a flow of fresh water, e.g., for a rinse cycle. It should be appreciated that water supply valve 156 may be positioned at any other suitable location within cabinet 102. In addition, although water supply valve 156 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through chamber opening 132, and washing operation is initiated through operator manipulation of input selectors 162. Wash tub 124 is filled with water, detergent, and/or other fluid additives, e.g., via spout 152 and or detergent drawer assembly 200. One or more valves (e.g., water supply valve 156) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through chamber opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring to FIG. 1, a schematic diagram of an external communication system 170 will be described according to an exemplary embodiment of the present subject matter. In general, external communication system 170 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 170 may be used to transfer data or other information to improve performance of one or more external devices or appliances and/or improve user interaction with such devices.

For example, external communication system 170 permits controller 166 of washing machine appliance 100 to communicate with a separate device external to washing machine appliance 100, referred to generally herein as an external device 172. As described in more detail below, these communications may be facilitated using a wired or wireless connection, such as via a network 174. In general, external device 172 may be any suitable device separate from washing machine appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with washing machine appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control washing machine appliance 100, etc. In addition, external device 172 and remote server 176 may communicate with washing machine appliance 100 to communicate similar information.

In general, communication between washing machine appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with washing machine appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Referring now to FIGS. 1 through 8, the detergent drawer assembly 200 that may be used with the washing machine appliance 100 will be described according to example embodiments of the present subject matter. As explained above, detergent drawer assembly 200 receives the wash additive (e.g., detergent, fabric softener, bleach, or any other suitable liquid or powder). As such, detergent drawer assembly 200 includes a detergent drawer 210 that defines one or more chambers 212 therein for receiving various wash additives and/or water. The detergent drawer 210 is slidably mounted within the front panel 130. In this manner, the detergent drawer 210 permits selective access to chamber(s) 212 by being movable/slidable between an open or extended position (FIGS. 4-6) facilitating access to the chamber(s) 212 and a closed or retracted position (FIGS. 1-3, 8) prohibiting access to the chamber(s) 212. Notably, as explained above, the chamber(s) 212 occupy the accessible space of the detergent drawer 210, which is the space exposed when the detergent drawer 210 is extended. However, detergent drawer 210 also has space that is covered by a top panel 138 of the cabinet 102 when the detergent drawer 210 is extended. In conventional detergent drawer assemblies, such space would be inaccessible. Accordingly, however, aspects of the present subject matter are directed to detergent drawer assembly 200 and features for addressing these and other issues experienced with conventional detergent drawer assemblies.

Figure 5:
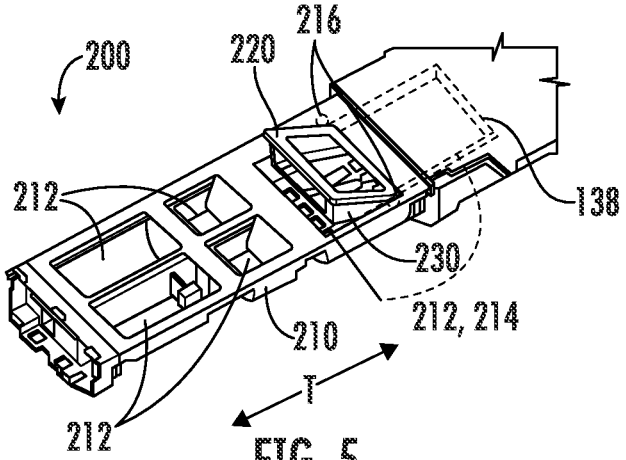
FIG. 5 provides another perspective view of the example detergent drawer assembly of FIG. 4 according to an example embodiment of the present subject matter.
Figure 6:
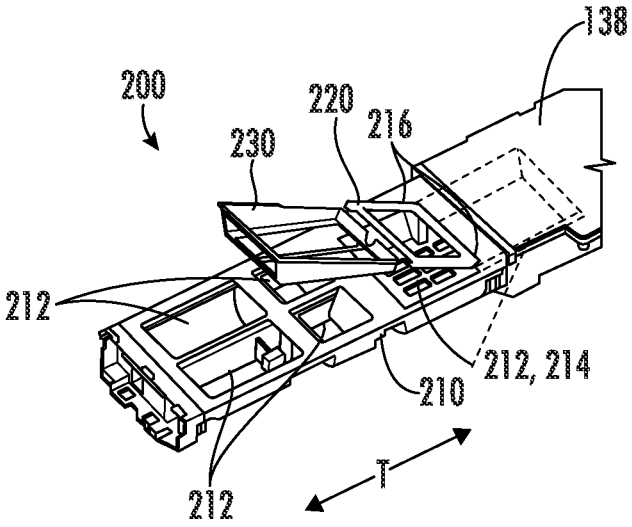
FIG. 6 provides another perspective view of the example detergent drawer assembly of FIG. 4 according to an example embodiment of the present subject matter.

According to example embodiments, one of the chambers 212 defined by the detergent drawer 210 of the detergent drawer assembly 200 is a cartridge chamber 214 for receiving a cartridge therein, such as a filter cartridge 230 (FIGS. 5-8) for use in filtering particles from water received within the cartridge chamber 214. As best illustrated in FIGS. 5 and 6, the cartridge chamber 214 is positioned at the rear of the detergent drawer 210 in the transverse direction T. As such, when the detergent drawer 210 is in the extended position, a portion of the cartridge chamber 214 is covered by the top panel 138 of the cabinet 102.

Figure 7:
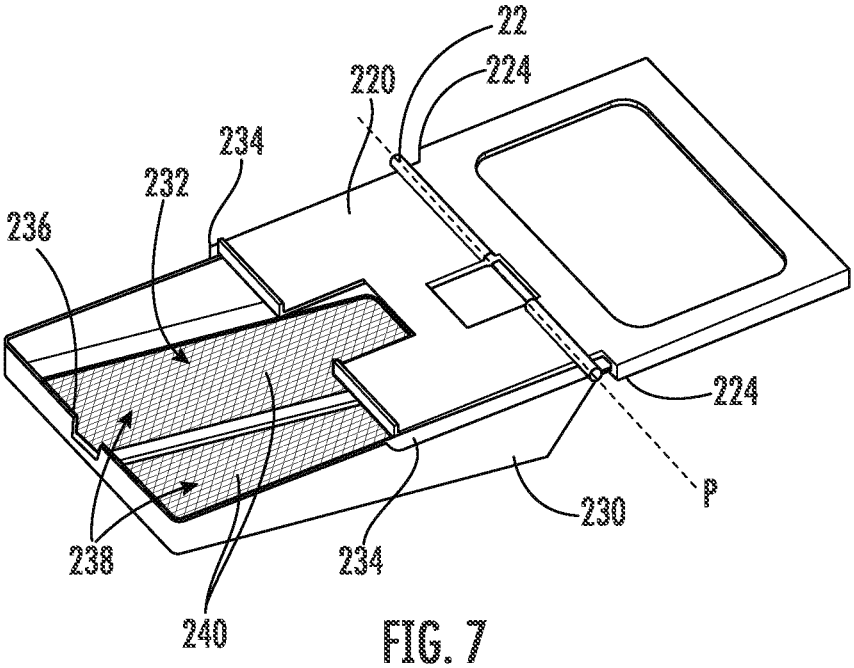
FIG. 7 provides a perspective view of a hinged plate and a filter cartridge of the example detergent drawer assembly of FIG. 4 with the filter cartridge in the extended position according to an example embodiment of the present subject matter.

As best illustrated in FIGS. 5 through 7, detergent drawer assembly 200 may also include a hinged plate 220. The hinged plate 220 is rotatably mounted to the detergent drawer 210 for providing selective access to the cartridge chamber 214 and the filter cartridge 230 mentioned above. Notably, contrary to conventional designs, the hinged plate 220 and the filter cartridge 230 of the detergent drawer assembly 200 may facilitate access to the portion of the cartridge chamber 214 that is covered by the top panel 138 of the cabinet 102 which, in conventional detergent drawer assemblies would be inaccessible space.

The filter cartridge 230 is mounted to the hinged plate 220 and rotates with the hinged plate 220. The hinged plate 220 is rotatable between an open position (FIGS. 5-6) facilitating access to the filter cartridge 230 and the cartridge chamber 214 and a closed position (FIG. 4) in which the filter cartridge 230 is positioned within the cartridge chamber 214. For example, according to exemplary embodiments, the hinged plate 220 may include a pin 222. The pin 222 may be received within a pair of drawer bosses 216 defined on or within the detergent drawer 210 and may define a pivot axis P about which the hinged plate 220 is rotatable between the open position and the closed position.

As best illustrated in FIG. 7, the filter cartridge 230 defines a filter chamber 232 for receiving a filter (not shown) for filtering particles from water received within the cartridge chamber 214. The filter cartridge 230 is slidably mounted to the hinged plate 220 when the hinged plate 220 is the open position. In this manner, the filter cartridge 230 permits selective access to the filter chamber 232 and, thus, the filter (not shown), by being movable/slidable between an open or extended position (FIG. 7) facilitating access to the filter chamber 232 and a closed or retracted position (FIG. 5) in which the hinged plate 220 covers the filter chamber 232 and the filter cartridge 230 is received within the cartridge chamber 214. For example, according to exemplary embodiments, the filter cartridge 230 may include a pair of flanges 234 for receiving within a pair of flange inserts 224 defined by the hinged plate 220 so the filter cartridge 230 is slidable between the extended position and the retracted position. Furthermore, as best illustrated in FIG. 5, when the filter cartridge 230 is in the retracted position, at least a portion of the filter cartridge 230 is received within the portion of the cartridge chamber 214 covered by the top panel 138 of the cabinet 102.

The filter cartridge 230 may be fluidly coupled to a recirculation system and recirculation pump so that the filter (not shown) within the filter chamber 232 receives recirculated wash fluid/water from sump 142 and filters particles from the recirculated wash fluid/water. In this manner, wash fluid/water may be recirculated within washing machine appliance 100 for improved water efficiency and filtered prior to exiting the washing machine appliance 100 for preventing harmful particles from entering the environment.

Figure 8:
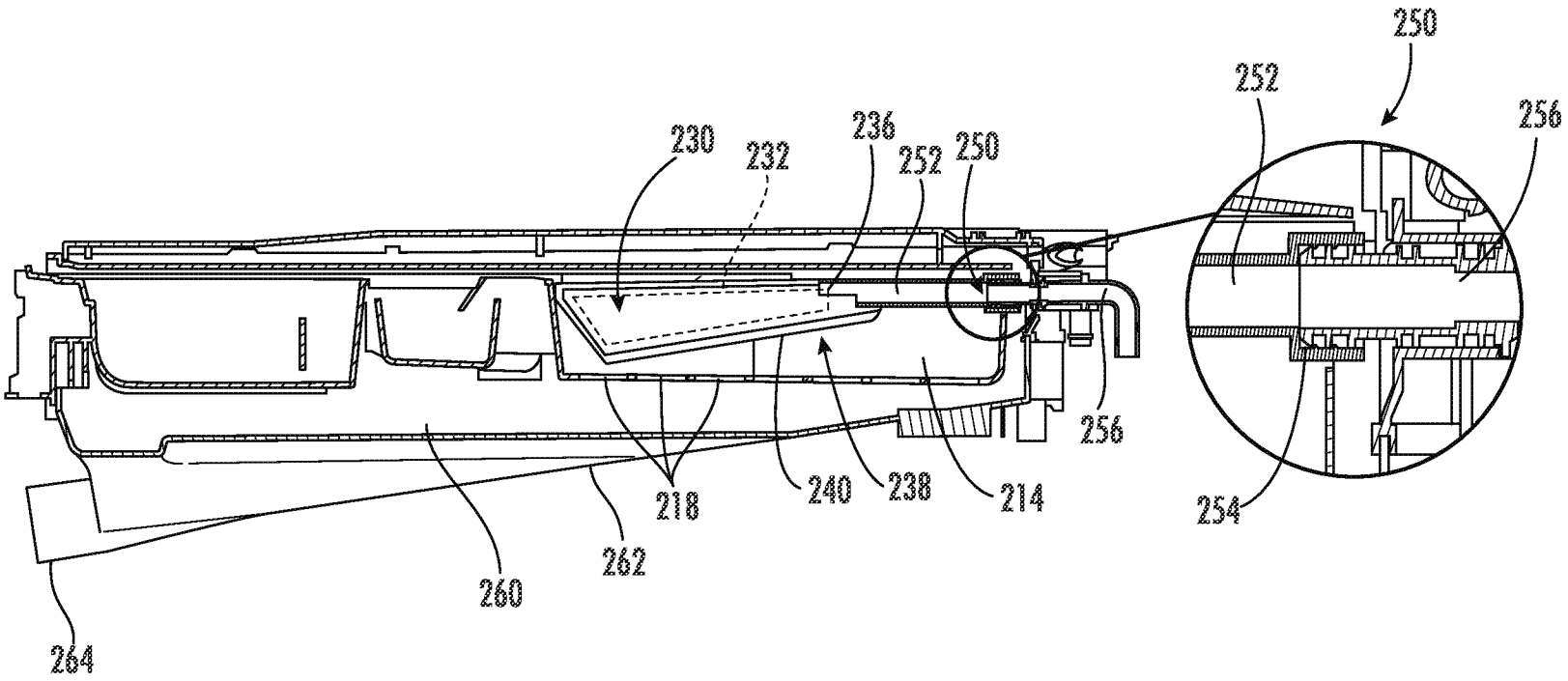
FIG. 8 provides a side cross-sectional view of the example detergent drawer assembly of FIG. 4 according to an example embodiment of the present subject matter.

As best illustrated in FIG. 8, the wash fluid/water may enter the filter chamber 232 of the filter cartridge 230 via a recirculation nozzle 250 directed into the filter cartridge 230 when the detergent drawer 210 is in the retracted position. In this respect, the recirculation nozzle 250 may be received within a cartridge opening 236 (FIGS. 7-8) defined by the filter cartridge 230 when the detergent drawer 210 is in the retracted position. For example, according to exemplary embodiments, the recirculation nozzle 250 may include an internal conduit 252 received within the cartridge opening 236 for conveying wash fluid/water to the filter chamber 232. The recirculation nozzle 250 may also include an external conduit 256. The internal conduit 252 may define a conduit boss 254 for engaging/receiving the external conduit 256 therein when the detergent drawer 210 is in the retracted position and, thus, establishing a fluid coupling/connection between the external conduit 256 and the internal conduit 252 such that wash fluid/water may be conveyed between the internal conduit 252 and the external conduit 256. Furthermore, the internal conduit 252 may be fixed to the detergent drawer 210 such that the internal conduit 252 moves with the detergent drawer 210 between the extended position and the retracted position. In this respect, as the detergent drawer 210 is moved toward the extended position, the internal conduit 252 disengages or separates from the external conduit 256.

As best illustrated in FIGS. 7 and 8, the filter cartridge 230 may include one or more walls 238 each being formed with a screen or mesh filter 240 to assist the filter (not shown) within the filter chamber 232 from filtering particles from the recirculated wash fluid/water. The recirculated wash fluid/water may freely pass through the mesh filter 240 of the wall(s) 238 and into the cartridge chamber 214 of the detergent drawer 210 while the mesh filter 240 separates particles from the recirculated wash fluid/water and contains/traps the particles within the filter chamber 232 of the filter cartridge 230.

As best illustrated in FIG. 8, the detergent drawer assembly 200 may also include a drawer chute 260 for directing the filtered recirculated water to the wash tub 124. The drawer chute 260 may thus be positioned below the cartridge chamber 214 in the vertical direction V for receiving filtered recirculated water from the cartridge chamber 214 via one or more drain holes 218 defined by the bottom of the cartridge chamber 214. The drawer chute 260 may define a sloped wall 262 such that the filtered recirculated water is directed toward a chute drain 264 and, thus, to the wash tub 124.

As explained herein, aspects of the present subject matter are generally directed to a detergent drawer assembly design of a washing machine appliance that includes a rotatable hinged plate and a slidable cartridge chamber. This detergent drawer assembly including the rotatable hinged plate the slidable cartridge chamber facilitates access to previously inaccessible space of the portion of the detergent drawer contained within the washing machine appliance when the detergent drawer is open/extended. Newly accessible space within the detergent drawer may be utilized for filtering particles from recirculated wash fluid to prevent harmful particles from entering the environment.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet comprising a front panel defining a chamber opening, the cabinet further comprising a top panel;

a wash tub positioned within the cabinet and defining a wash chamber;

a wash basket rotatably mounted within the wash tub for receiving a load of clothes; and a detergent drawer assembly slidably mounted within the cabinet for receiving a wash additive and directing the wash additive to the wash chamber during operation of the washing machine appliance, the detergent drawer assembly comprising:

a detergent drawer slidably mounted to the cabinet and defining a cartridge chamber;

a hinged plate mounted to the detergent drawer and being rotatable between an open position and a closed position; and a cartridge defining a chamber, the cartridge being slidably mounted to the hinged plate when the hinged plate is in the open position.

2. The washing machine appliance of claim 1, wherein the cartridge is positioned within the cartridge chamber when the hinged plate is in the closed position.

3. The washing machine appliance of claim 1, wherein, when the hinged plate is in the open position, the cartridge is slidable between an extended position for providing access to the chamber, and a retracted position in which the cartridge is received within the cartridge chamber.

4. The washing machine appliance of claim 1, wherein the detergent drawer is slidable between a retracted position and an extended position in which a portion of the cartridge chamber is covered by the top panel of the cabinet.

5. The washing machine appliance of claim 4, wherein at least a portion of the cartridge is received within the portion of the cartridge chamber covered by the top panel of the cabinet when the cartridge is in the retracted position.

6. The washing machine appliance of claim 4, further comprising:

a recirculation nozzle directed into the cartridge when the detergent drawer is in the retracted position.

7. The washing machine appliance of claim 6, wherein the cartridge defines an opening for receiving the recirculation nozzle when the detergent drawer is in the retracted position.

8. The washing machine appliance of claim 1, wherein the cartridge is a filter cartridge and the chamber defined by the cartridge is a filter chamber for receiving a filter for filtering particles from recirculated water.

9. The washing machine appliance of claim 1, wherein the detergent drawer defines a drawer chute for directing filtered water from the chamber to the wash chamber.

10. The washing machine appliance of claim 1, wherein the cartridge rotates with the hinged plate.

11. The washing machine appliance of claim 1, wherein the hinged plate of the detergent drawer assembly comprises:

a pin defining a pivot axis about which the hinged plate is rotatable, the pin being received in a pair of bosses defined on the detergent drawer.

12. The washing machine appliance of claim 1, wherein the cartridge of the detergent drawer assembly comprises:

at least one wall formed with a mesh filter.

13. A detergent drawer assembly for a washing machine appliance, the washing machine appliance comprising a cabinet comprising a top panel and a front panel defining a chamber opening, the washing machine appliance also comprising a wash tub positioned within the cabinet and defining a wash chamber, the detergent drawer assembly slidably mounted within the cabinet for receiving a wash additive and directing the wash additive to the wash chamber during operation of the washing machine appliance, the detergent drawer assembly comprising:

a detergent drawer slidably mounted to the cabinet and defining a cartridge chamber;

a hinged plate mounted to the detergent drawer and being rotatable between an open position and a closed position; and a cartridge defining a chamber, the cartridge being slidably mounted to the hinged plate when the hinged plate is in the open position.

14. The detergent drawer assembly of claim 13, wherein the cartridge is positioned within the cartridge chamber when the hinged plate is in the closed position.

15. The detergent drawer assembly of claim 13, wherein, when the hinged plate is in the open position, the cartridge is slidable between an extended position for providing access to the chamber, and a retracted position in which the cartridge is received within the cartridge chamber.

16. The detergent drawer assembly of claim 13, wherein the detergent drawer is slidable between a retracted position and an extended position in which a portion of the cartridge chamber is covered by the top panel of the cabinet.

17. The detergent drawer assembly of claim 16, wherein at least a portion of the cartridge is received within the portion of the cartridge chamber covered by the top panel of the cabinet when the cartridge is in the retracted position.

18. The detergent drawer assembly of claim 16, wherein a recirculation nozzle of the washing machine appliance is directed into the cartridge when the detergent drawer is in the retracted position.

19. The detergent drawer assembly of claim 18, wherein the cartridge defines an opening for receiving the recirculation nozzle of the washing machine appliance when the detergent drawer is in the retracted position.

20. The detergent drawer assembly of claim 13, wherein the hinged plate comprises:

a pin defining a pivot axis about which the hinged plate is rotatable, the pin being received in a pair of bosses defined on the detergent drawer.

* * * * *